US010434558B2

(12) United States Patent
Sines

(10) Patent No.: US 10,434,558 B2
(45) Date of Patent: Oct. 8, 2019

(54) TOOLPACK FOR MANUFACTURING CONTAINERS

(71) Applicant: CanForming Systems, LLC, Broomfield, CO (US)

(72) Inventor: James A. Sines, Broomfield, CO (US)

(73) Assignee: CANFORMING SYSTEMS, LLC, Broomfield, CO (US)

( * ) Notice: Subject to any disclaimer, the term of this patent is extended or adjusted under 35 U.S.C. 154(b) by 0 days.

(21) Appl. No.: 15/474,031

(22) Filed: Mar. 30, 2017

(65) Prior Publication Data

US 2018/0281045 A1 Oct. 4, 2018

(51) Int. Cl.

| | |
|---|---|
| ***B21D 22/28*** | (2006.01) |
| ***B21D 22/20*** | (2006.01) |
| *B21D 51/26* | (2006.01) |

(52) U.S. Cl.

CPC ..... *B21D 22/286* (2013.01); *B21D 22/20* (2013.01); *B21D 51/26* (2013.01)

(58) Field of Classification Search

CPC ..... B21D 51/26; B21D 22/28; B21D 22/286; B21D 22/20; B21D 22/30

See application file for complete search history.

(56) References Cited

U.S. PATENT DOCUMENTS

| | | | | |
|---|---|---|---|---|
| 3,402,591 A | | 9/1968 | Maeder | |
| 3,656,335 A | | 4/1972 | Kaminski | |
| 3,771,344 A | | 11/1973 | Wright | |
| 3,812,696 A | | 5/1974 | Kneusel et al. | |
| 4,065,951 A | | 1/1978 | Lyu | |
| 4,151,927 A | | 5/1979 | Cvacho et al. | |
| 4,223,544 A | | 9/1980 | Main | |
| 4,262,512 A | | 4/1981 | Maeder | |
| 4,324,124 A | * | 4/1982 | Maeder | B21D 22/28 72/345 |
| 4,373,368 A | | 2/1983 | Heijting | |
| 4,554,815 A | * | 11/1985 | Weishalla | B21D 22/28 72/349 |
| 4,930,330 A | | 6/1990 | Weishalla | |
| 5,020,350 A | | 6/1991 | Knepp et al. | |

(Continued)

OTHER PUBLICATIONS

Patent Cooperation Treaty International Search Report and Written Opinion for PCT 2018/US2018/023866, dated May 31, 2018, 7 pgs.

(Continued)

*Primary Examiner* — Pradeep C Battula

(74) *Attorney, Agent, or Firm* — Pepper Hamilton LLP

(57) ABSTRACT

A precision high cyclic rate metal forming toolpack is disclosed for ironing processes used to produce can or other bodies and preforms of ultra-high precision. An example of the toolpack provides improved centering, dampening and force attenuation response. In an example, the toolpack may be implemented with integrated feedback communication and sensoring. An example of the toolpack also provides unified coolant distribution, including enhanced locational intelligence of infinitely variable tooling positions. An example of the toolpack also provides improved axial and longitudinal articulation for improved tool tracking and floatation. The toolpack may enable improved product quality, throughput, manufacturing efficiency, reduced costs, and reduced labor.

20 Claims, 8 Drawing Sheets

(56) References Cited

U.S. PATENT DOCUMENTS

| | | | | |
|---|---|---|---|---|
| 5,056,350 | A | 10/1991 | Moen et al. | |
| 5,555,761 | A * | 9/1996 | Lavy | B21D 22/28 72/347 |
| 5,692,409 | A * | 12/1997 | Cheers | B21D 22/28 72/349 |
| 6,598,451 | B2 * | 7/2003 | Blue | B21D 22/28 72/342.3 |
| 7,107,811 | B2 * | 9/2006 | Zauhar | B21D 22/21 72/349 |
| 7,526,938 | B2 | 5/2009 | Dunwoody et al. | |
| 7,805,970 | B2 | 10/2010 | Woulds | |
| 9,079,238 | B2 | 7/2015 | Crabtree | |
| 9,192,976 | B2 * | 11/2015 | Yannone | B21D 22/20 |
| 2003/0084700 | A1 | 5/2003 | Blue | |
| 2006/0086170 | A1 | 4/2006 | Zauhar | |
| 2018/0133770 | A1 | 5/2018 | Swedberg | |

OTHER PUBLICATIONS

Screenshot of website: https://www.pawlingep.com showing Custom Rubber and Plastic Products Engineered to Meet your Exact Specifications, known by inventor to be publicly available at least as early as Nov. 2017, 6 pgs.

Screenshot of website: http://www.tekscan.com showing embedded sensors, known by inventor to be publicly available at least as early as Mar. 2017, 5 pages.

"Tekscan I-Scan Product Selection Guide", known by inventor to be publicly available at least as early as Jul. 2018, 28 pages.

Seal Master Corporation, "Seal Master Engineered Inflatable Seats", known by inventor to be publicly available at least as early as Jul. 2018, 8 pages.

* cited by examiner

TOOLPACK FOR MANUFACTURING CONTAINERS

BACKGROUND

Metal forming toolpacks are utilized in the ironing apparatus for manufacture and form of metallic can bodies or cylindrical metal bodies and preforms. The metal forming toolpack is commonly constructed of various modules utilized to control the tooling arrangements to produce beverage or food containers integral within the metal forming apparatus of the 'draw(n) and iron' press or 'wall ironer'. The toolpack may include multiple modules which house and integrate the ironing tooling(s) to iron and form the metal thickness of specific geometrically shaped metallic bodies.

Existing toolpacks are limited by configuration and use of mechanical springs or Urethane type spring replacements in fixed radial locations. The limited locational action provides a fixed directional force rate which has no adjustability, nor any discernible communication with the process. Different spring rates are only changed with significant machine down time, mechanical exchanges of spring elements through operator intervention, and significant guess work by skilled analysis. These dampening limitations cause significant degradation of product quality, resulting in lower production speed and efficiency The Global unit production of aluminum and/or steel beverage containers and bottles is approximately 200 billion units per year. More than 90 billion units are produced in the United States each year. The speed and accuracy at which these billions of metallic containers are produced with such high volumes in complex manufacturing systems, requires the utmost accuracy and manageability of total product population variation.

Manufacturers control the container weight to the milligram and the measurement of the container walls are held within microns. This is simple if making only a single unit, but much more difficult for manufacturing billions. Approximately 400 units are produced every minute on a single apparatus. Factories are typically using over 8 to 10 of these metal forming machines in a line. As such, the entire production line speed often exceeds 2,000 cans per minute. Manufacturing billions of units thus requires extremely high precision and control to ensure that the least amount of material is being utilized, with lowest variations in wall thicknesses. Any variation is multiplied by millions of units rapidly multiplied material misuse. It is important not to make mistakes or mismanage any variation rapidly due to high speed to maintain a consistent and competitive end unit cost.

Those skilled in the art of producing billions of such units understand weight control and management of variance across 200 billion units is an ideal aspect of conserving required materials and optimized production facility efficiency that drive most competitive unit cost basis. Therefore, the interaction of the toolpack and ironing process variance dictate the material weight distribution and is critical to ideal process management outcomes over billions of units. The lack of external attenuation control or adjustment in current production systems, and a limited capability to optimize ironing process variance, negatively impacts speed of production and quality of the product being produced.

DETAILED DESCRIPTION

Figure 1:
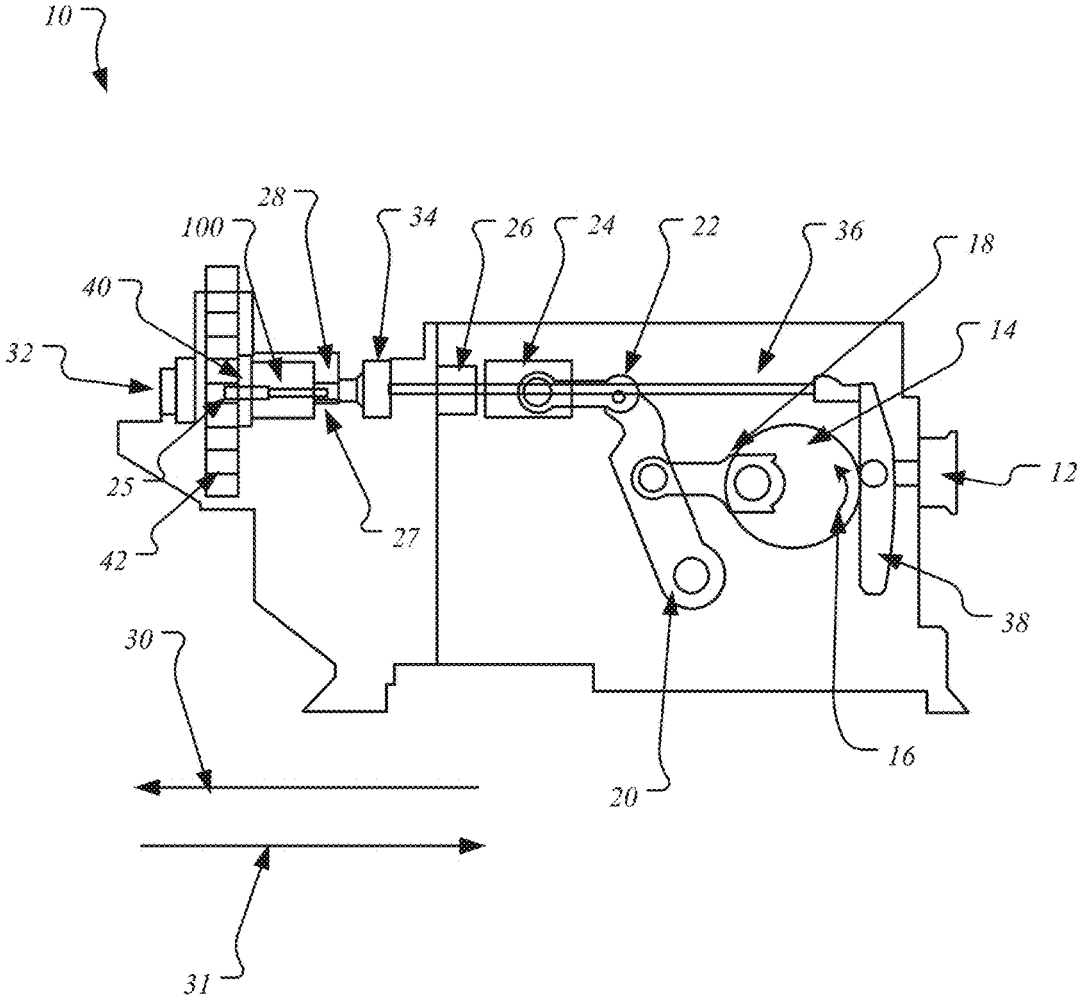
FIG. 1 is a high-level perspective illustration of a metal forming apparatus 1 implementing an example toolpack disclosed herein.

The toolpack and systems and methods described herein greatly improve the ability to manage and control can weight, can wall variation, material utilization, tooling wear rates, improve machine efficiency and therefore manage production performance at the lowest achievable cost basis. The limitation of manufacturing process ironing control variables of dampening speed, action, adjustment and control is directly improved through these enclosed novel embodiments of the invention.

An example high cyclic rate precision metal forming toolpack is disclosed as it may be implemented for the ironing process to form can bodies or other cylindrical bodies and preforms at high rates of speed with minimal variance. The example toolpack improves dampening and force attenuation of tooling control through an integral and contiguous biasing medium structure which is externally excited and communicated. The example toolpack results in a reduction of variance in produced container wall thicknesses. The example toolpack also facilitates improved production speed, product quality, reduced tooling wear, resulting in an improved can weight control, reduced wall variation, improved coolant distribution, coolant impingement, and coolant tracking.

The example toolpack can be readily implemented into existing production apparatus such that both skilled technicians, and non-experienced operators are better enabled to operate the complex ironing processes. In an example, the toolpack enables critical process optimization through adjustability without having to shut down the equipment that would otherwise result in a loss of production volume and profit. An average loss of profit near $85 per minute or every 2,000 cans made, quickly focuses losses resulting from any downtime. These unique aspects help to vastly improve production system management control, production throughput, efficiency and provide novel automation of existing ironing processes. The average efficiency of existing production averages near 85% for common art. With the improvement discussed herein, efficiency of 90% or greater can be achieved.

Automation of these manufacturing systems reduces labor requirements of the utilized machinery work cells and this reduces overall manning requirements of production. The financial savings of labor while increasing production efficiency at a lower unit cost basis is one of the claimed embodiments of this invention.

Before continuing, it is noted that as used herein, the terms "includes" and "including" mean, but is not limited to, "includes" or "including" and "includes at least" or "including at least." The term "based on" means "based on" and "based at least in part on." The terms "can" and "container" are used interchangeably herein to refer to the product being formed. The term "tool" or "die" may be used interchangeably herein to refer to the ironing tooling and/or ironing die. The term "drawn" or "ironed" may be used interchangeably herein to refer to the refer to the process of drawing and ironing of metallic bodies.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to entirety of the particular embodiments illustrated herein.

FIG. 1 is a high-level perspective illustration of an example metal forming apparatus 10 implementing an example toolpack 100 disclosed herein. The example apparatus 10 may be operated to produce light-weight containers, including food or beverage containers and bottle preforms, e.g 'Bodymaker', 'Wall-ironer' or 'Canformer'.

The process of the can body formation begins by the formation of a cup article in a separate machine, called a 'cupping press'. First, a circular "blank" is cut out of a flat sheet of metal. The disc-shape is blanked and fed through the tooling of a cupping press. The blank is "drawn" or pulled through such tooling into the shape of a "cup". The cup article is then transferred to the apparatus 10 to feed the can body formation process of 'draw and iron' (D&I).

In an example, the apparatus 10 includes a continuous motion flywheel and clutch brake assembly connected directly to a crankshaft 14. Operation of the crankshaft is one revolution results in a single stroke. The cam on the crankshaft 14 follows a motion controlled force by air-bag 12 onto a clamping redraw carriage 34 to control the cup article to be formed into the container, Rotation of the crankshaft 14 is typically counter clockwise as noted by direction of arrow 16. The mechanism linkage operates via primary connecting rod 18 the swing lever 20 to drive secondary connecting rod 22 against slide yoke 24 and ram bushing 26. This action drives or "pushes" ram 28 in the direction of arrow 30 through toolpack 100 and up against domer 32.

The complete cycle of one revolution of the crankshaft 14 completes with return or "pull" of the ram 28 in the direction of arrow 31. The cam follower mechanism timely returns the redraw carriage 34 connected to redraw push rod 36 and the hold-down lever 38 releasing the cup and opening for next cup placement. The crankshaft is similar that of a car engine (one piston) and cams operate the clamp mechanism to hold the cup. The punch/ram are moving at about 500 strokes per minute (about 26 inches) in each direction.

The draw and iron process includes loading the cup article into the redraw tooling 27, clamping the cup, then the ram 28 forces a punch tool 25 through. During the forward stroke, the bottom of the cup is pushed on the punch 25 such that the side walls of the cup article are drawn or "stretched" as the ram 28 moves through the toolpack 100, thus giving the cup an elongated shape of the formed can body 8. Each stage of the tooling reduces the containers walls and elongates the container height correspondingly.

The can body 8 being formed is then "stripped" or released from the ram 28 via stripper 40 on the return stroke, and taken away by the unloader assembly 42. Many machines are also equipped with high pressure air stripping assistance due to the high rates of speed to remove the container 8 from the punch 25. This automatically discharges the formed containers 8 such that the next can body 8 may be formed.

Various ironing apparatus drive mechanism designs exist in the market as common art: examples are Hypocycloid gear drive, watts linkage drive and various parallel motion assemblies, etc. The consistency of the ironing apparatus 10 all use the 'toolpack' 100 to iron metal into various container shapes. The drive mechanism of the apparatus is only used for example and description of invention application, understanding various other drive mechanisms may be utilized with the invention of the metal forming toolpack 100.

An entire cycle of the ironing apparatus (both the forward and return stroke) is completed in one continuous motion of 360 degrees crankshaft rotation at very high cyclic rates (e.g., between 150-500 cycles per minute (cpm)) producing a single container 8 per a complete single stroke. The toolpack 100 controls the deformation of the metal container wall between carbide tooling of the ironing die(s) 47 and the punch 25. Typically, containers 8 require a redraw operation and multiple ironing operations to reduce the wall and elongate the container to the desired shape and specifications within a toolpack. The ram 28 is typically under ultra-high forming pressures, loads, velocities and thermal conditions as the frictional aspects of ironing increase significantly as production speeds increase forming velocities directly.

The friction of the tools and resultant thermal reactions of the metal ironing process often determines the quality of the resultant container that is produced. The ironing process reduces the container wall thicknesses of the starting material (e.g., the cup) by about 25%-75%, and elongates the container walls into the desired final container height and geometric shape. The desired tolerances of container walls are required within microns and normal variations desired of final wall thickness are within +/−0.00015" (7.6 microns).

Process variation adversely affects the quality of can body wall and finished can weight accuracy. Process variance increases as the thermal conditions vary due to production speeds and duration requirements of 24 hour a day production schedule requiring measured precision control and consistency to produce desired product accuracy. Process variance also increases as the die movement attenuation of ironing forces in axial, radial and/or lateral directions may become instable or degrade during the ironing process. Forming velocity has been traditionally limited by these conditions and interactions resulting in increased variance at high speeds above 350 units per minute.

The metal forming toolpack 100 disclosed herein may be utilized to improve the energy of dampening, speed of dampening and reduced variance of force attenuation during the ironing process. The production speed of the ironing apparatus is improved in combination with improved stability of the process variance over time, and this results in improved consistency of unit quality and lower wall variance of formed containers and preforms produced.

Before continuing, it should be noted that the example apparatus 10 described above is provided for purposes of illustration, and is not intended to be limiting. Other devices and/or device configurations may be utilized to carry out the operations described herein.

Figure 2A:
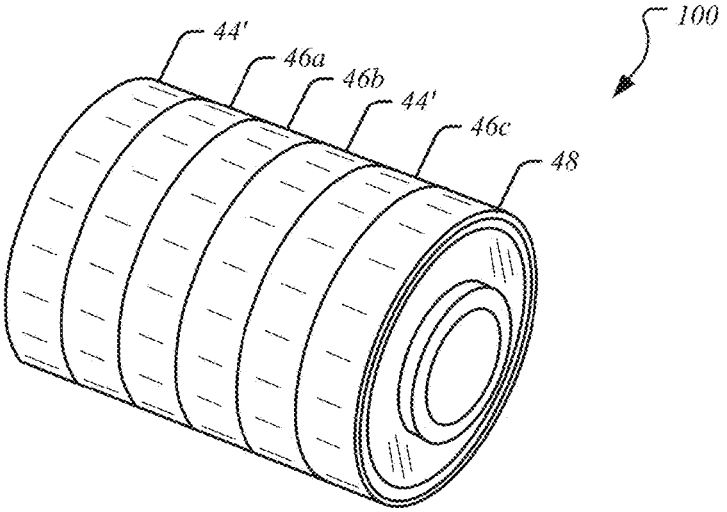
FIG. 2A is a perspective view of an example toolpack disclosed herein.
Figure 2B:
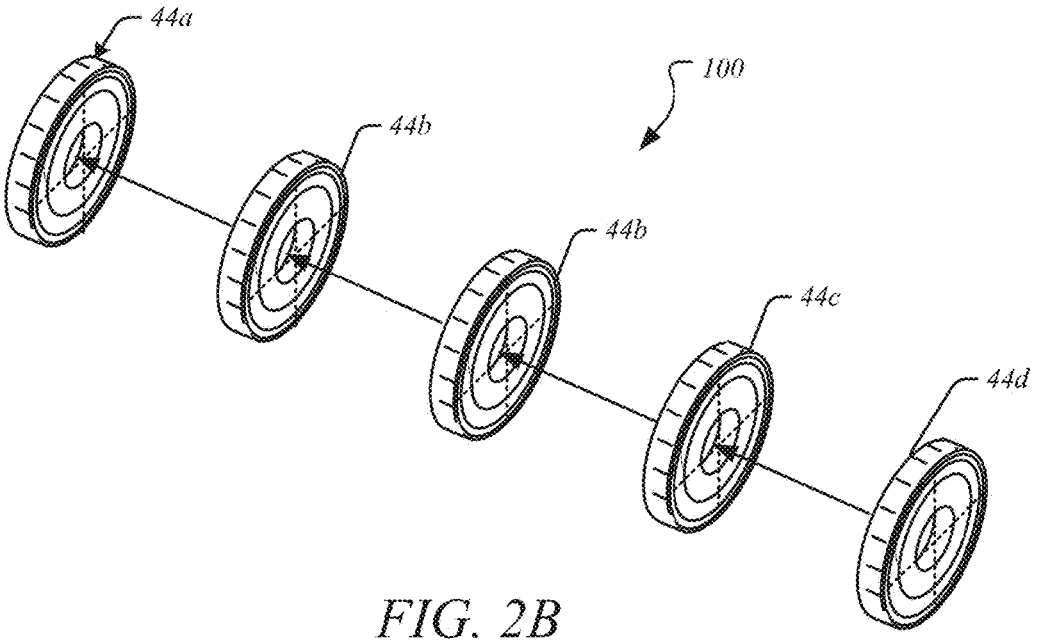
FIG. 2B is an exploded perspective view of the example toolpack shown in FIG. 2A.

FIG. 2A is a perspective view of an example toolpack 100 disclosed herein. FIG. 2B is an exploded perspective view of the example toolpack modules of toolpack 100 shown in FIG. 2A. In an example, toolpack 100 may be utilized to control the tooling arrangements required to produce beverage or food containers during the draw and iron process.

In an example, toolpack 100 may include one or more modules 44 and one or more spacer(s) 46. The modules 44 house and integrate at high speed the ironing tooling(s) to iron and form the metal thickness of specific geometrically shaped metallic bodies. The spacers 46 simply dictates the length required between dies 47 of the ironing elongation changes of the process. It is noted that the toolpack 100 is not limited to any spec configuration and/or number of module(s) 44 and/or spacer(s) 46.

Figure 3:
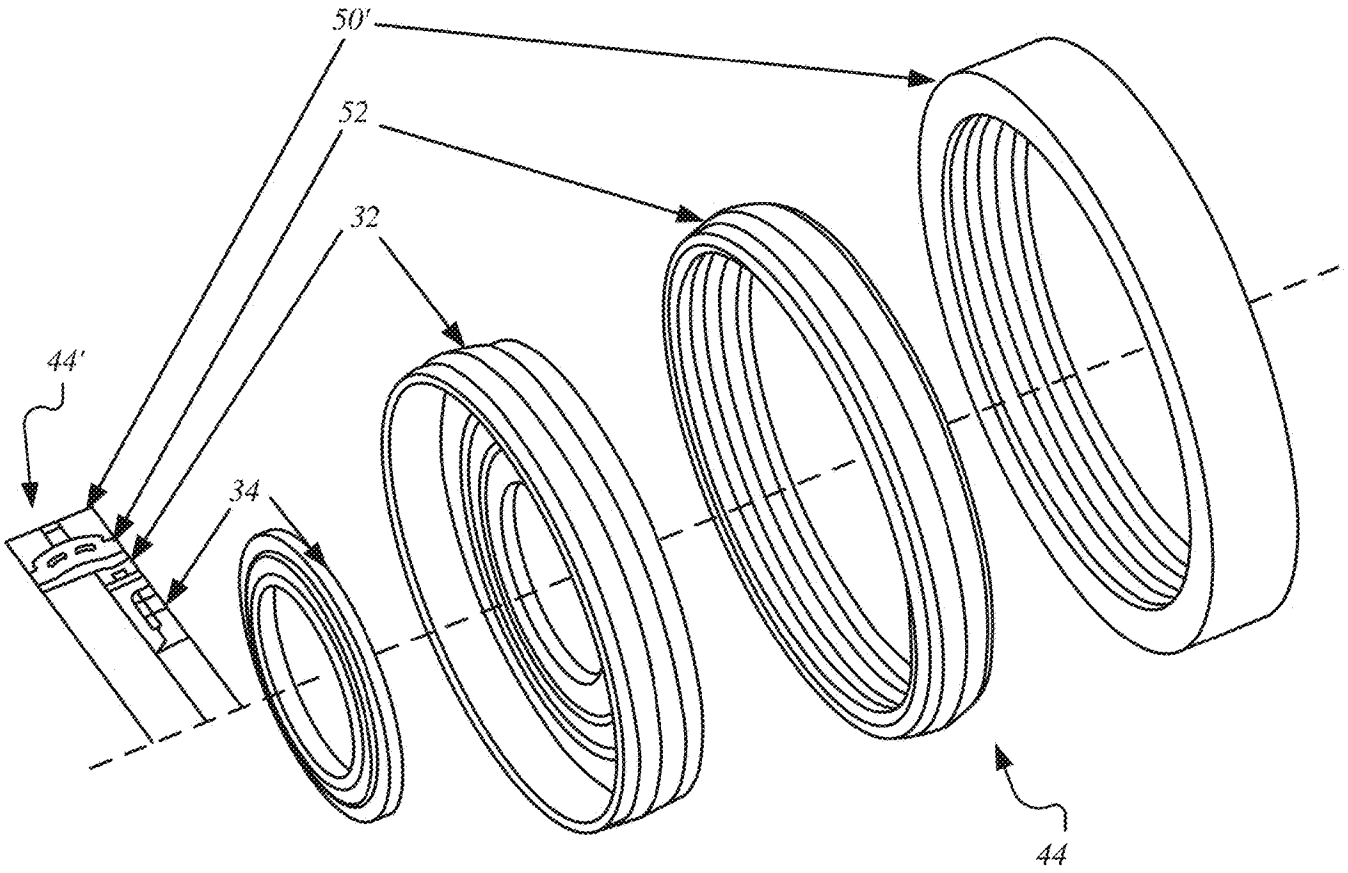
FIG. 3 is an exploded perspective view of one of the toolpack modules.

FIG. 3 is an exploded perspective view of one example of the toolpack modules 44. The toolpack modules may have various configurations, as described within reference FIG. 4 and FIG. 5 as demonstrated. However, each of the toolpack module 44 may include the general configuration of a module housing ring 50, dampening structure 52, die carrier 32, and coolant nozzle 34. FIG. 3 illustrates correspondence of the perspective view of the module 44 variations shown in FIG. 4 with the close-up partial (e.g., upper) cross-sectional views of the various modules 44 shown in FIG. 5.

Figure 4:
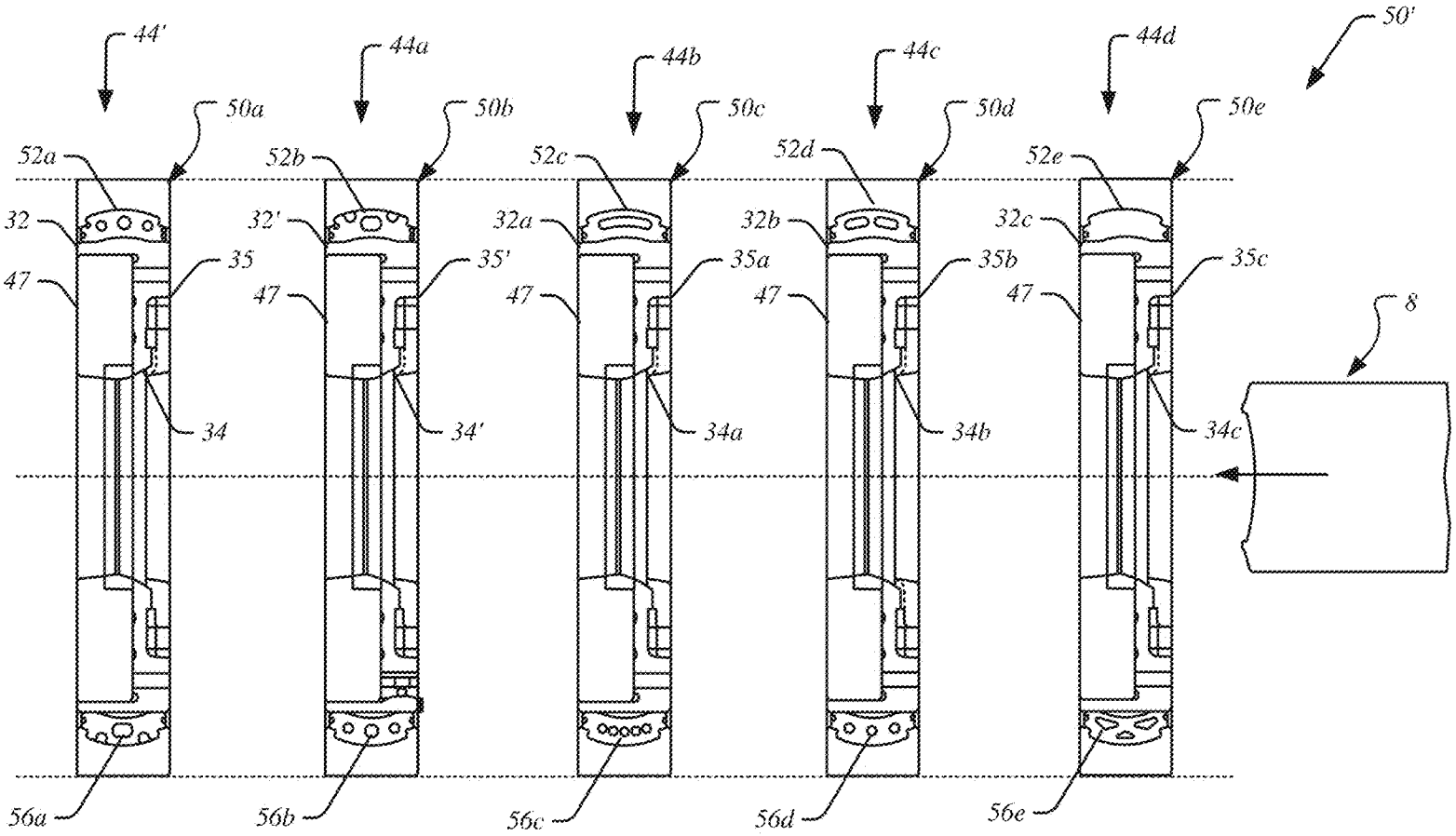
FIG. 4 are cross-sectional views of various modules of the example toolpack. One or more of these may be implemented in a toolpack.

FIG. 4 shows cross-sectional views of various modules 44' of the example toolpack modules shown in FIG. 3 of toolpack 100. One or more of these modules 44' may be implemented into a single toolpack 100'. Any and all combinations of Dampening structures 52' may be mounted in the tooling module housing ring 50'. The die carriers 32' may be mounted in the dampening structures 52'. Ironing dies 47' are mounted in the die carriers 32'.

Individual toolpack modules 44" may be configured to accept any size tooling 47'. Current Industry standard is a six inch diameter by three-quarter inch wide carbide dies. There is no limitation of the design to incorporate other die 47 sizes of various diameters and thicknesses. The toolpack 100 of the dampening structure 52 accommodates various diameter changes via die carrier ring 32 as well ability to accommodate new configurations not shown by example.

The dampening structures 52*a-e'* includes a unified structural dampening design which centralizes articulation forces and attenuation of the ironing dies, thereby maximizing spring energy, die centralization and speed of attenuation response. The dampening structures 52*a-e* may include variations of structures molded from urethane or Viton (or other suitable material) for desired attenuation performance and long service life. The durometer of the dampening structure 52' may vary for each die position, e.g., to improve die 47 attenuation of actual ironing forces ideal for that sequence. For example, a dampening attenuation force for a die 47*a* in the second ironing sequence operation in the toolpack 100 may be a higher attenuation force than the forces required for a die 47' in the third sequence of ironing. These attenuation differences are mainly controlled by the metal formation physics of material reduction, friction, lubrication and tool geometries.

The dampening structures 52*a-e* may include an attenuation design with internal pressurization geometries that centralizes attenuation forces of the ironing dies 47*a-e* requirements of the metal formation process. The geometry of the dampening structures 52*a-e* may be configured to provide variable dampening rates of attenuation to accommodate various process changes. Numerous example geometries 56*a-e* are demonstrated internally within the dampening structures 52*a-e* for example only. These sample cross section for each of the modules 44*a-e* demonstrate innumerable geometric and material combination options to ideally create radial configurations that optimize ironing attenuation performance. It is clear that one or more of these various dampening attenuation structures may be implemented into a toolpack 100.

The dampening structure 52' may incorporate various internal geometric options 56' of improved dampening attenuation forces through external excitation and communication. Internal connection enables internal pressure chambering 56 to change the media 52 dampening attenuation response. The variability of media attenuation improves tool 47 centering as well as speed of articulation of the integrated tooling 47 requirements.

The internal geometries 56' may include various media, fluids, gases, gels or other pressuring systems. The media may also be intermixed or constructed integrally with various reinforcement materials and/or geometries 56'. Examples include but are not limited to fibers, Kevlar™, steel cable, and/or various cording and/or energizing cabling construction types of attenuation reinforcement. These improved attenuation options may extend performance life of the dampening medium for millions of cycles to last through years of demanding production.

The dampening medium 52' functions in unison of displacement attenuating the ironing tooling 47' within the dampening structure 52*a-e*, also integrating the coolant distribution 34*a-e*

The coolant distribution nozzle 34*a-e* focuses the coolant impingement into the ironing area. The nozzle focus may maintain a stable thermal temperature during the ironing speed and reduce metal ironing during the manufacturing process of canmaking.

The speeds are typically as much as five hundred inches per second (or 45 ft/s). This equates to 30 miles per hour average forming velocity for each container produced. It is clear that these high rates of metal forming speed require complete and intimate control of the coolant and tool movements. The proper application and impingement of coolant is important to controlling the ironing temperature at these high rates of velocity. Excessive temperatures can cause a loss of material strength through localized tempering. Excessive temperature can result in product failure, jams, and/or defects being created that negatively impact product quality aspects. These high rates of forming speeds demand high precision to maintain optimal and stable metal forming temperatures.

Figure 5:
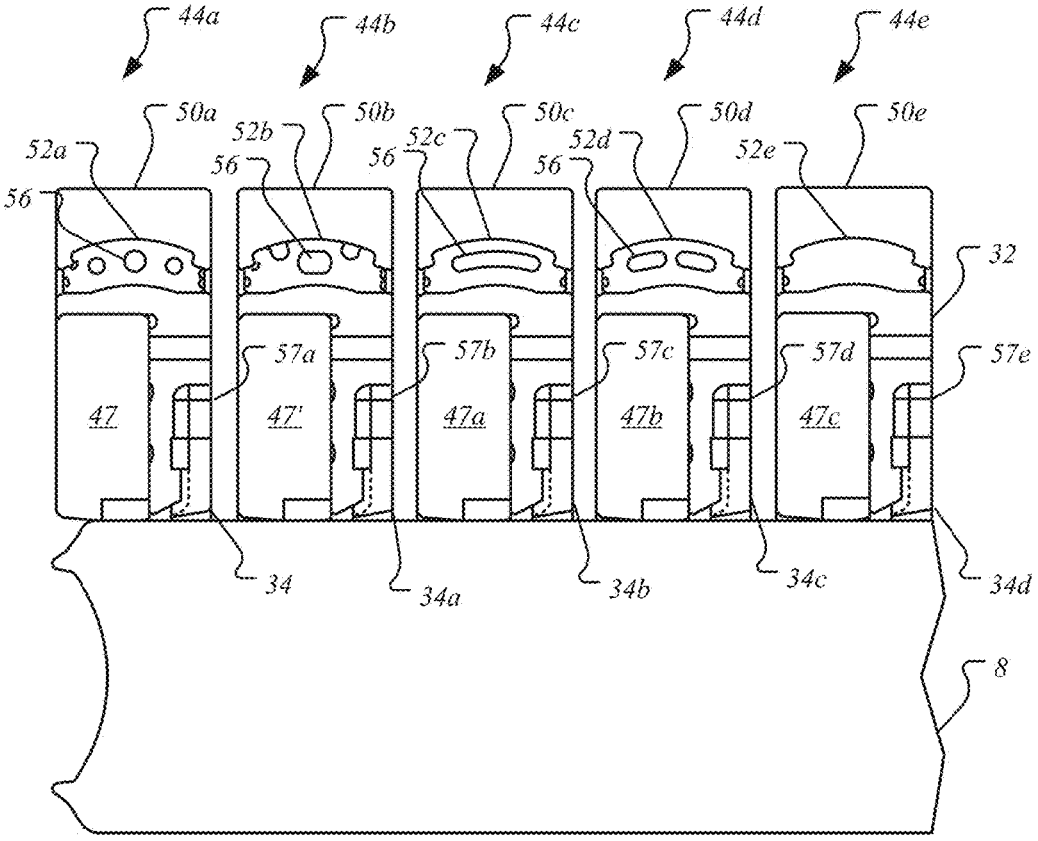
FIG. 5 are detailed cross-sectional views of an upper portion of the various modules shown in FIG. 4.

The coolant channels 57*a-e* are incorporated within the die carriers 32*a-e*, as better viewed in FIG. 5. FIG. 5 are detailed cross-sectional views of an upper portion of the various modules shown in FIG. 4. Coolant may be provided via coolant channels 57*a-e* feeding the coolant nozzle 34*a-e*. This enables coolant delivery that can be optimized locationally focused into the ironing zone. The example embodiment uniquely incorporates the nozzle geometry to perfectly locate during any and all displacements of the dies 47*a-e* (e.g., as the die 47 moves or floats during the ironing process, the coolant moves in unison 34*a-e*). In an example, coolant delivery may be adjusted to optimize coolant delivery at the work area of the dies 47*a-e*.

Figure 6:
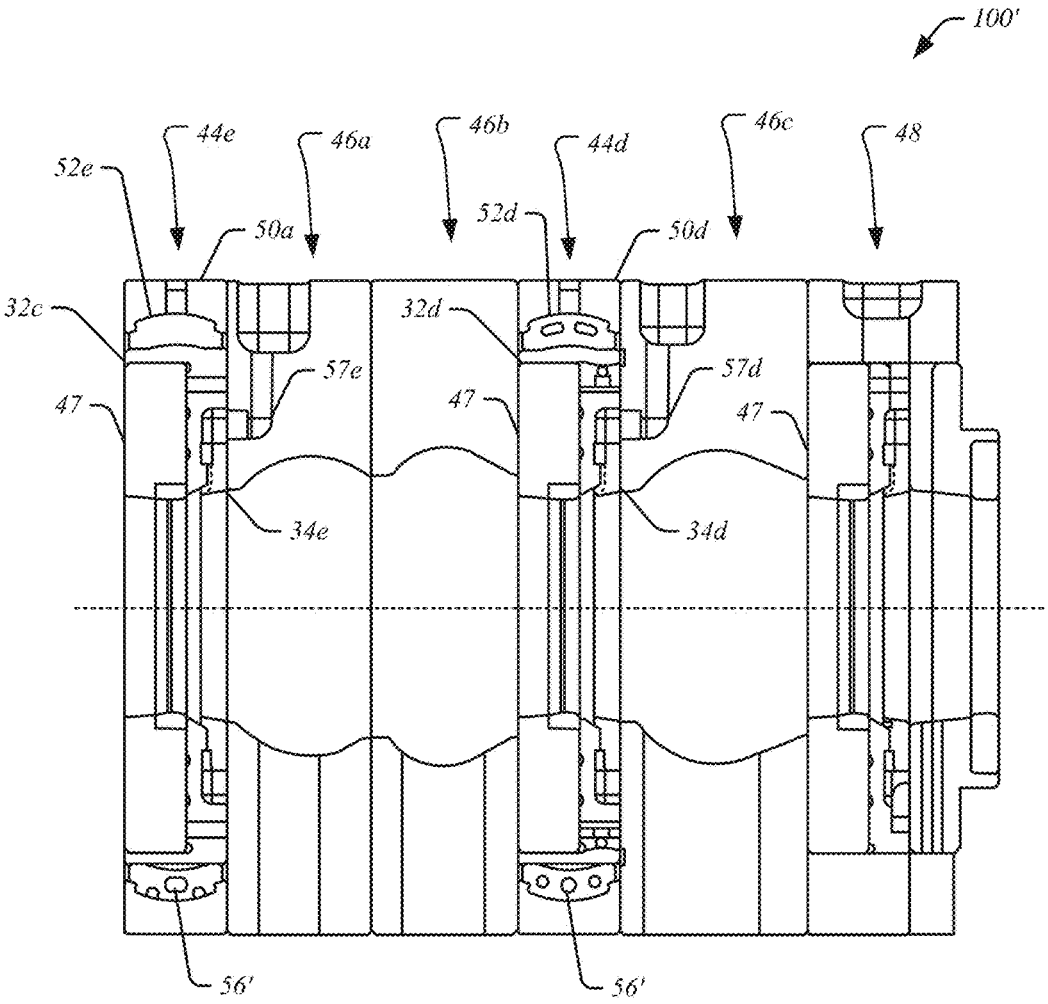
FIG. 6 is a detailed cross-sectional view of typical arrangement of the modules of the example toolpack.

FIG. 6 is a detailed cross-sectional view of typical arrangement of the modules of the example toolpack 100. In this example, the modules are assembled into the toolpack 100 illustrated in FIG. 2A, including modules 44*e* and 44*d*, spacers 46*a-c*, and redraw module 48. The toolpack 100 is illustrated of variably defined geometric structure and makeup of dampening structures (e.g., 52*e* and 52*d* are shown), combined with integrated die carrier rings (e.g., 32*e* and 32*d* are shown) and coolant structures (e.g., 34*e* and 34*d* are shown).

Figure 7:
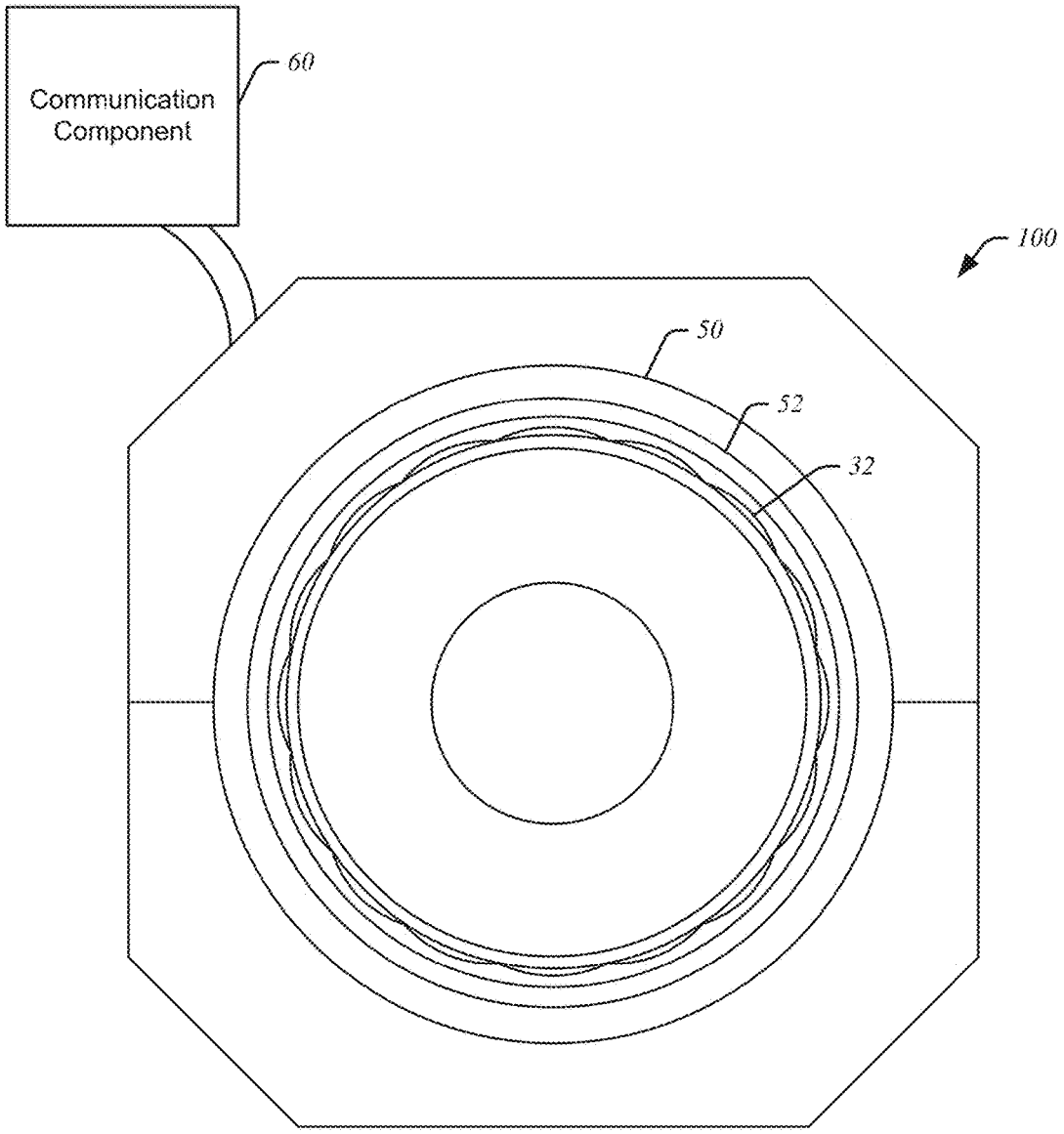
FIG. 7 is an end view of one of the modules of the example toolpack.

FIG. 7 is an end view of one of the example toolpack 100. The die elements 47 of the toolpack 100 shown in FIG. 6 may be configured with coolant distribution by coolant nozzle rings 34. These coolant distribution ports 57 feed nozzle 34 are not limited to fixed locational die 47 articulation changing impingement in all current art. This novel example, the articulation of coolant distribution 34 is focused in unison to track the tool position automatically in continuous displacement with die carrier 32. The coolant nozzle 34 always moves wherever the die 47 moves. This improves the coolant contact impingement and the locational focus of the coolant impingement improves thermal consistency of the ironing zone(s). The coolant nozzle 34 and distribution automatically tracks, moves, and distributes coolant impingement to an infinite variance of tooling positions directly improving thermal stability and thermal efficiency of ironing geometric intensity. This enables improved metal forming production rates, container quality, tool life and reduced tool wear through the improved coolant impingement, geometrically optimized thermal stability and contiguous tool tracking resulting in thermally stable ironing processes at higher speeds.

In an example, the toolpack 100 may improve the centering and dampening response of the necessary tooling with vastly increased radial energy. The increased mass of dampening structure 52 improves speed and action of the tooling 47 such that improved tooling response articulation to product quality demands, increased throughput, improved manufacturing efficiency and direct process feedback is achieved. Ideal management of these high production speeds and the sheer volume of billions of annual units produced is vastly improved by the increased speed of force attenuation features and external excitation methods of the example invention.

The toolpack 100 may also enable integration of dampening energy adjustability and tool articulation through increased centering forces infinitely oriented structurally in a united and focused external excitation means. Managing these ironing responses requirements may be further automated through linked communication to the process and/or quality systems. The toolpack 100 may implement a complete axial and lateral force adjustment during the machine operation and cycling. Examples result in vast improvement of the production efficiency, throughput and quality of containers produced by the novel ability to adjust and/or optimize centering force response and dampening quickness of the toolpack 100.

Existing art has been measured at 85%-92% efficient for best in class operations around the World. Those skilled in the art readily understand these efficiencies 85%-92% are best in class. It is a claim of this invention to support and enable significant improvement of efficiency and throughput by removing the manual requirements of process optimization. The manual intervention always results in a loss of production throughput. Maximum machine speeds are never exceeded or a catch-up speed is not viable due to the current limitation of production speeds are less than 400 cpm. Production is always lost each and every time the ironing machine is maintained for any adjustment to the process. The external excitation means and communication with the process variance is critical to achieving higher efficiencies and therefore producing vast gains in produced annual units via the apparatus speed up to 400 cpm, running 24 hrs/day, +360 days per year. Any time (even a minute) that the machine has to be shut down is a major loss in productivity. That lost production cannot be made up.

The toolpack 100 may further provide a novel application of integrated coolant distribution with specifically optimized locational displacement tracking, movement unification and directly calibrated communication of variable tooling positions upon novel integration of die carrier 54 and coolant distribution structure.

The toolpack 100 further provides improved dampening speed of axial and longitudinal articulation obligations of the tool ironing process displacements and attenuation variance through increased force mass structure combined with explicit geometric medium construction of dampening structure 52.

The toolpack 100 further provides full axial conformity of greater quickness and force range by integrating completely encompassing directional articulation, responsively reducing tooling wear and improving tool life and performance of the congruent dampening structure 52.

The metal is normally sized through various stages or sequences of tooling or die(s). These normally include at least a single redrawing stage, directly followed by subsequent ironing sequence(s). The ironing process requirement are determined by the desired thickness and shape of the container required thinning the metal and elongating geometric shape limits of the material.

The speed at which these articles may be manufactured is often limited by the inherent inability to adjust or adapt forces of the tooling with intelligence to the process requirements readily or by demand. Lack of dampening or speed of reaction often results in excessive thickness variation which requires operator intervention and/or downtime of the apparatus to remedy. Metal forming velocity and manufacturing efficiency rates are degraded by frequency of created defects, which can stop, fault, or altogether shut down the apparatus 1, requiring operator intervention to restart.

The ironing process utilizes a toolpack 100 which incorporates and houses fixed and/or moveable die element(s). Multiple die elements are comprised of a steel casing and tungsten carbide or ceramic elements of standard geometric configurations utilized to form geometrically shaped metallic bodies. Due to the rapid cycling rate requirements, as much as 150-500 cycles per minute the dampening and vibration frequencies have been normally attenuated by a plurality of various fixed force rate biasing springs. The mechanical springs have been commonly used for many years and recent improvements have converted these springs to polymeric or urethane type spring configurations. However, these configurations lack any sort of force adjustment or attenuation adaption based upon production speed fluctuations, or variation of force requirements due to various process changes, or the optimization ability within process variables, such as material type, material coatings, friction, die type, lubrication, articulation, and/or formation velocities.

The toolpack 100 implements a dynamic centering force attenuation adjustability and intelligence which corrects limitations of die element dampening resulting from increased speed of attenuation induced by elevated ironing forces and process requirements induced from higher cyclic rates and reduced variation necessity. The novel dampening structure 52 may be implemented to adjust intensity of the dampening to improve the reaction speed of the tool to the workpiece through the optimization of force attenuation and energy focus with process intelligence (described in more detail below with reference to FIG. 8).

The variable intensity of dampening attenuation structure may be implemented as a unitary circumferential integration of a contiguous structure or structured geometrically involving full force range optimization. The dampening structure (or structures) 52 incorporated within the modules 44 have a substantially increased biasing mass to create an improved force intensity attenuation and dampening speed. In an example, the dampening structure 52 can be a fully adjustable and attenuated energy dampening structure by material construction as well combined with various geometric options, such as those shown as geometric profile options 56.

The toolpack 100 enables dampening intensity in a plurality of combinations of force attenuation(s) and orientation combinations of ideal fitment to the service requirement of the ironing and metal forming process of the metallic geometrically shaped bodies. The dampening structure medium 52 incorporates various combinations of geometric configuration, material variance, construction options in combination with external excitation (e.g., via communication component described below with reference to FIG. 8), produces countless options of design specificity to the metal formation process needs. The toolpack 100 also enables a plurality of options and various combinations, formulations of fitment within the biasing medium structure 52 to optimize the dampening response intensity profile via specific orientation, optional geometric profiles or construction within the machine axis of orientation. These variations enable the toolpack 100 to be optimized for the dampening force intensity needs and requirements of specific ideal radial orientations to the machine and metal forming orientation needs.

The toolpack 100 incorporates the novel configuration of the biasing medium 52 to include numerous geometric options of orientation such that regionalized force intensity profiles may be intelligently configured for various geometric shapes or process requirements. The novel ability to combine external force attenuation with geometric configuration creates a plurality of pattern combinations ideally suited for the interactive intelligent response of the metallic body formation process. The combined ability to enhance, arrange and patterning of the geometric variables 56 of the dampening structure 52 in combination with force attenuation is a unique and novel claim of this invention.

The toolpack 100 provides complete ability to optimize the cylindrical forces through varied regions of attenuation intelligence, such that accuracy of the roundness of the metallic cylinder formation and the thickness variation of the metallic cylinder walls is optimized. The structure of the biasing medium for dampening structure 52 enables various inputs of energy that may be ideally located to specific quadrants, regions or orientation of the specific metallic body requirements. This enables the invention to improve the dampening forces in various regions or alter various other regions to optimize the metal forming processes. The toolpack 100 improves metallic formation capability and quality regardless of geometric configuration of the metallic bodies.

The toolpack 100 directly improves attenuation of the die element 47 speed of movement and reaction to the process by the increased mass of the radial biasing medium structure of the dampening geometry 52 in complete radial integration of the entire circumferential configuration of the dies 47. The toolpack 100 embodies directly the increased biasing mass and volume of the resilient medium of dampening structure 52 being congruent and equally biasing response through the entirety of the radial geometry improving the speed of response demands and quickness of dampening. This improves the metal formation process as the die (tool) 47 maintains more consistent contact of the tooling and metal through the full and directional displacement communication with workpiece and tooling surfaces through a geometric balance of attenuated ironing forces.

The toolpack 100 specially provides increased structural configuration of energy of mass and dampening force attenuation with distinct equalizing axial communication through intelligent lateral dampening force control throughout the entire sequence of the ironing process actions. The toolpack 100 enables the integral dampening structure 52 of increased dampening means through the increased cross sectional mass energy in combined internal excitation means of completeness in biasment structure orientation options around the entirety of the geometric configuration of the toolpack module and die tooling 47 directly improving manufacturability, product quality, production speed and process capabilities.

The toolpack 100 also includes the integration of a complete radial centering medium of significant design variation, pattern configuration 56 and construction such that the ironing die elements (tools) 47 may be quickly and repeatedly centered to a 'home' position with greater accuracy and speed. The dampening structure 52 includes biasment options in a plurality of internal geometric arrangements and configurations, resulting in significantly improved quickness of tool 47 action and intelligent response to the process requirements resulting in optimized ironing forces. In an example, the toolpack 100 improves the die 47 attenuation and centering response to maintain a centralized or 'home' position such that production and manufacturing speeds, quality and throughput are greatly enhanced over prior art. This novel embodiment combines the unified compliant medium structure 52 with options in a plurality of integrated geometric shapes 56, structures and as well materials. The toolpack 100 enables infinite options of centering and biasing force intensities that may be ideally enhanced by construction, material combinations and internal geometric applications chambering 56 when combined with the ability to be externally attenuated 62 and/or excited dampening or systematic force response intelligently 64.

The toolpack 100 may further provide complete circumferential dampening force adjustability of definitive force intensity required of the ironing forces through novel combination of dampening structure 52 and a communication control unit 60, discussed in more detail below with reference to the communication 60 and control system 64 of FIG. 8. In an example, the toolpack 100 may responsively augment the force and quickness of dampening feedback directly automating and optimizing the metal forming processes to the ideal requirements of ironing through novel combination of the dampening structure 52 attenuation, excitation and the communication control unit 62. In an example, the toolpack 100 may provide novel configurations of communication to the manufacturing process 200 such that the system of manufacture may now become configured for autonomous control and management resulting in significantly reduced labor, improved quality and higher production throughput. The toolpack 100 yields a novel ability to increase speed capability, while providing a distinct ability to adapt and adjust the communication intelligently 200 on demand to coordinate optimal force responses resulting in much lower variation at much higher production rates and metal forming velocities. This vastly improves manufacturing efficiency and apparatus production throughput.

Figure 8:
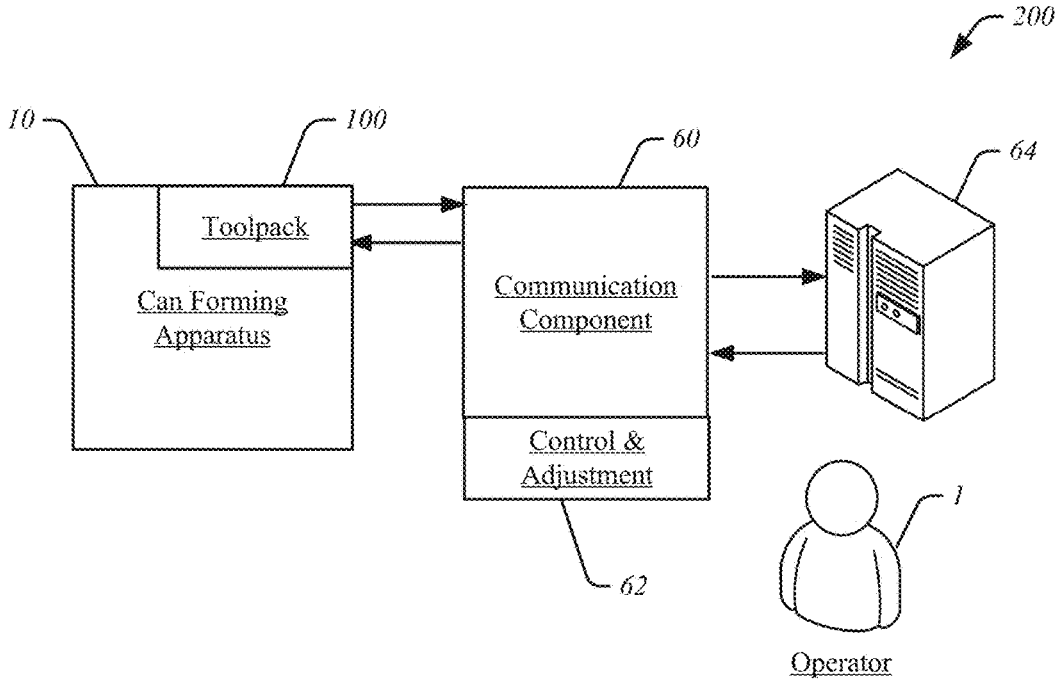
FIG. 8 is a high-level block diagram illustrating communication and feedback which may be implemented for the example toolpack.

FIG. 8 is a high-level block diagram illustrating communication 64 and feedback 60 which may be implemented for the example toolpack 100 via a communication and control system 62. The communication and control system 200 may include a communications component 60 operable to self-adjust and modulate 62 associated with the toolpack 100 (see, e.g., FIG. 7) of the can forming apparatus 10, and a controller or processor 64. In an example, a user or operator 1 may interact with the communication 60 and control system 200 via a control and adjustment interface 62. In another example, the control and adjustment interface 62 may be entirely automated and/or simply monitored by operator 1.

In an example, a tooling communication and control system 200 may be provided for the toolpack 100. The communication and control system 200 enables adjustment of the dampening force intensity 62. In an example, the communication component 60 controls, senses and adjusts the toolpack 100 biasment due to process requirements through external excitation methods. This communication also enables intelligent feedback through direct sensing and interaction during the metal forming process so that the tooling forces can be optimized without disassembly or intervention in the apparatus 100, reducing or altogether eliminating machine 10 stoppage and associated loss of production. The communications component 60 also enables logical management of a specific intensity of required attenuation forces for ironing in a controlled methodical and scientific manner to dampen, excite and optimize the variable movements of the die elements 47 during the ironing process, being comprehensively optimizable, adjustable through external excitement 62, with distinct interactive specific commands issued to the tooling. The communications, sensing and control component 60 also enables optimization via unskilled operator 1 to use simple adjustments 'on the fly', to change, correct and optimize the intensity of the metal formation forces with diverse and directional correlation via intelligent control communications 60.

The adjustability of the toolpack 100 enables the enhancement and correlation of the management of process inputs to optimize performance within the complexity of the numerous random process variables of material alloy or type, material thickness, speed of machine cycle rates, increasing metal forming velocities and a plurality of process induced input variations which may now be directly sensed, correlated and intelligently 64 managed to specific set points or measurements. These readings, set-points and adjustments can be predictable from various other process combinations, data mining such that they become programmed 200 into the production requirements of specific configurations or ideal product needs. This enables production planning, and process optimization for various container sizes, requirements and variable process needs to improve overall size change, labor requirements, production efficiencies and unit output. These embodiments enhance this novel simplification of intelligent process adjustment 200, scientific optimization and manageable regulation of the ironing process. This unique ability to sense, adjust, enhance and change the toolpack 100 system demands enables the operator 1 to intelligently optimize the intensity of dampening forces of the die elements 47 centering, attenuation and reaction speed for each application such that the improved quality, increased speed of production, ramp up slope and the net efficiency of manufacture of metallic bodies 8 is systematically enhanced through managed scientific optimization of the metal forming process.

The communication component 60 significantly improves the manufacturing production speed, efficiency and quality of the metallic cylinders by interactively attenuating the dampening force intensity profile of the unique dampening structure medium 52. The communication component 60 provides the ability to optimize the external management of tooling response with process feedback and sensing of the ironing and metal formation tooling interactions directly enabling attenuation adjustment automatically or by operators and technicians to increase machine speed, cycle rates and quality of containers produced.

Container weight(s) or management of the weight of the metallic body is measured with high frequency to control scrap weight and saleable container weight resulting in overall material usage efficiency. The system provides process feedback of weight variance via the communication component 60, and the ability to sense and externally adjust the force excitation of the tool within the metal forming process, may improve the management capabilities of production parameters 200. The production control is critical to success as the volume of units is 500/minute which is: 30,000 units per hour, 720,000 units per day, equaling 260 million units per year, for each machine 10. Management of these process variables may improve the quality of the containers produced as well as reduce the tool wear, tool usage requirements and material consumption rates. Highly intelligent container weight control process management systems 200 may be implemented to control the metallic material consumption and final product material volumes with ultra-high precision and consistency over the entire production population of billions of units 8.

The communication and control component 60 also provides the ability to sense and communicate dampening, centering force intensity through a plurality of pressurization means and mechanisms arrangements of the attenuation and dampening structure 52. External excitation in combination with sensing and complete geometric options of material structure 56 magnifies the arrangement intelligence of combinations and capabilities 62 with unique and novel communication control of the metal forming process 64. This example further facilitates automation development 200 of the ironing and metal forming process such that instrumentation and sensing capabilities of the toolpack modules 44 may continue to be developed and intelligently simplified.

In an example, the communication component 60 may also enable instrumentation via MEMS or micro sensors, temperature, force, vibration, Bluetooth' or related pressure sensing devices and articulation feedback of the modules 44'. As such, the process automation with direct measurement, feedback and process controls 60 of ideal configuration can be harmonized and linked by the production management systems 64. An example may include the contiguous dampening medium structure 52' of various geometric chambering patterns 56' or shapes combined with various excitation materials to enable a simplified measurement, sensing and response system. Various geometric pockets 56 and/or pressure or displacement sensing feedback regions may be placed to ideally communicate the attenuation requirements of the process intelligently. The integrated medium structure 52 of dampening medium may also provide distinct attenuation and precise process feedback, various measurements and communication with manufacturing system automated controls 200.

The ability to self-monitor, sense and measure system responses can be linked directly to the self-adjustability through automated pressure valve(s) or force attenuation systems which directly adjust and vary changes of attenuating forces or dampening response of the dies 47. Alternatively, the pressure mediums of dampening structure 52 attenuation may be a plurality of sources, such as hydraulic, magnetic or other readily available force mechanisms to modulated tool position and dampening attenuation of the dies 47 based upon correlated communication feedback with statistical process control measurements of can bodies 8 and a plurality of various other process measurements of the production or quality systems. Corresponding force attenuation via quadratic relationship or regional geometrically specific sensing and/or excitation may be directly altered automatically in force intensity or attenuation demands directly improving the variance and performance of the metal formation processes.

In an example, the communication component 60 can directly communicate with statistical process control (SPC) systems and/or automated manufacturing systems interlinking the ability to sense, attenuate, adjust, monitor and/or optimize the dampening intensity demands directly reducing manning and labor requirements of the prior art processes. Recording various manufacturing metrics of the ironing process over production intervals of time enables intelligence of process never before created by existing art. This permits the automation of manufacturing management processes to dynamically communicate and/or measure each toolpack module, to each individual die element, each container produced or any various combinations of lines or machine(s), apparatus throughout the entirety of the container manufacturing system.

It will be understood by those having ordinary skill in the art after becoming familiar with the teachings herein that the toolpack 100 and the communication component 60, provide a competitive advantage to create a self-autonomous manufacturing system(s) of the metal forming and ironing processes. The variable geometric configurations of the continuous geometric biasment structures 52 and combination of patterns throughout the entirety of the container shape provide a creative ability of attenuating forces, dampening externally, sensing feedback without complexity and high cost of construction—while maximizing process capability, intelligence and economic value of options to easily manipulate benefits of production speeds and container quality without stoppage of the machine. The examples described herein provide direct claim to increase unit production, unit quality and net output while reducing manning and labor requirements over a lower unit cost basis through higher production speeds and improved product quality.

It is noted that the examples shown and described are provided for purposes of illustration and are not intended to be limiting. Still other examples are also shown and contemplated.

The invention claimed is:

1. A toolpack for manufacturing containers, the toolpack having a plurality of individual modules and a control system, each module comprising:

a module ring;

a dampening structure within the module ring, the dampening structure comprising a contiguous dampening mechanism comprising at least one pressurized chamber;

a die carrier and an ironing die within the dampening structure;

a coolant structure integrated within the die carrier; and one or more sensors configured to produce a signal indicative of a parameter;

wherein the control system is coupled with the dampening structure, and wherein the control system is configured to receive the signal from the one or more sensors and adjust the at least one pressurized chamber based on the signal.

2. The toolpack of claim 1, wherein the adjustment of the at least one pressurized chamber is configured to centralize articulation forces and attenuation of the ironing die.

3. The toolpack of claim 1, wherein the dampening structure is performs radial articulation and lateral force intensity attenuation through adjustment of the at least one pressurized chamber.

4. The toolpack of claim 1, wherein adjustment of the at least one pressurized chamber provides adjustable force intensity attenuation.

5. The toolpack of claim 1, wherein the dampening structure provides an axial and lateral dampening force.

6. The toolpack of claim 1, wherein the at least one pressurized chamber comprises a plurality of various geometric chambers in geometric configurations selected based on a desired force intensity, attenuation and service longevity of the dampening structure.

7. The toolpack of claim 1, wherein the at least one pressurized chamber further comprises a plurality of geometric chambers located at different locations around or within the contiguous dampening mechanism.

8. The toolpack of claim 1, wherein the contiguous dampening mechanism is actively energized.

9. The toolpack of claim 1, wherein the contiguous dampening mechanism is passively energized.

10. The toolpack of claim 1, wherein the parameter is one or more of pressure, location, temperature, or vibration.

11. The toolpack of claim 1, wherein the at least one pressurized chamber is adjustable by fluid, gels, or electrical/magnetic excitation based on the signal from the one or more sensors.

12. The toolpack of claim 1, wherein the adjustment of the at least one pressurized chamber produces responsive articulation in both a radial axis and a lateral axis.

13. The toolpack of claim 1, wherein the control system is further configured to adjust the coolant structure based on movement of the ironing die.

14. The toolpack of claim 1, wherein the control system is configured to adjust the at least one pressurized chamber within the contiguous dampening mechanism on the basis of a desired product quality being produced by the toolpack.

15. The toolpack of claim 1, wherein the control system is configured to receive external sensor readings from the die carrier including monitoring of tool positional energy, intensity and speed of dampening response mechanics.

16. The toolpack of claim 1, wherein the contiguous dampening mechanism is a molded structure.

17. The tool pack of claim 16, wherein the molded structure comprises urethane or Viton.

18. A toolpack for manufacturing containers, the toolpack having a module comprising:

a module ring;

a dampening structure within the module ring, the dampening structure comprising a contiguous dampening mechanism comprising a plurality of pressurized chambers;

a die carrier and an ironing die within the dampening structure, wherein the contiguous dampening mechanism surrounds the die carrier;

one or more sensors configured to produce a signal indicative of a parameter; and a control system coupled with the dampening structure, wherein the control system is configured to receive the signal from the one or more sensors and adjust the pressurized chambers based on the signal to provide variable dampening rates.

19. The toolpack of claim 18, further comprising a coolant structure comprising a coolant nozzle configured to move in unison with the ironing die.

20. The toolpack of claim 18, wherein the plurality of pressurized chambers are spaced from each other and have different shapes to provide regionalized force intensity profiles in relation to a Cartesian orientation within the toolpack.

* * * * *